United States Patent [19]

Shishkin et al.

[11] Patent Number: 4,876,946

[45] **Date of Patent: * Oct. 31, 1989**

[54] FLEXIBLE HOSE PUMP

[76] Inventors: Viktor V. Shishkin, ulitsa Festivalnaya, 16, kv. 5; Nikolai F. Kryazhevskikh, ulitsa Krasnykh Partizan, 599, kv. 13; Jury P. Shapovalov, ulitsa Turgeneva, 18, all of Krasnodar, U.S.S.R.

[ * ] Notice: The portion of the term of this patent subsequent to Jul. 12, 2005 has been disclaimed.

[21] Appl. No.: 112,610

[22] PCT Filed: Dec. 19, 1986

[86] PCT No.: PCT/SU86/00139

§ 371 Date: Jul. 27, 1987

§ 102(e) Date: Jul. 27, 1987

[87] PCT Pub. No.: WO87/03936

PCT Pub. Date: Jul. 2, 1987

[51] Int. Cl.[4] ..... F01B 19/00; F16J 3/00

[52] U.S. Cl. ..... 92/93; 92/90; 92/48; 92/137; 92/72; 417/394

[58] Field of Search ..... 92/48, 49, 50, 89, 90, 92/91, 137, 93; 60/594; 417/394, 395

[56] References Cited

U.S. PATENT DOCUMENTS

| | | | |
|---|---|---|---|
| 2,428,912 | 10/1947 | Hulsberg | 92/90 |
| 3,417,942 | 12/1968 | Van Alstyne | 92/90 |
| 3,471,668 | 10/1969 | Wilkes | 417/394 |
| 4,616,556 | 10/1986 | Meilman et al. | 92/90 |
| 4,667,573 | 5/1987 | Shenker | 92/48 |
| 4,756,237 | 7/1988 | Shishkin et al. | 92/90 |

FOREIGN PATENT DOCUMENTS

| | | | |
|---|---|---|---|
| 918590 | 4/1982 | U.S.S.R. | 417/394 |
| 937801 | 6/1982 | U.S.S.R. | 92/89 |

*Primary Examiner*—Robert E. Garrett
*Assistant Examiner*—Thomas Denion
*Attorney, Agent, or Firm*—Burgess, Ryan & Wayne

[57] ABSTRACT

A pump comprising a casing (1) having interior space in which there is provided a flexible hose (2) mounted for reciprocations having one end (5) thereof which is turned inside out and secured along the perimeter to the inner wall of the casing (1), and the other end thereof which is closed so as to sealingly divide the interior space of the casing (1) into two chambers (6,7) of which one chamber (7) communicates with a source (12) of fluid being pumped and with a delivery line. In order to move the flexible hose (2) in one direction, its closed end is secured to a drum (3) operatively connected to a motor and installed in one of the chambers (6,7), and movement in the opposite direction is effected under the action of working fluid pressure built-up in one of the chambers (6,7).

11 Claims, 5 Drawing Sheets

FLEXIBLE HOSE PUMP

TECHNICAL FIELD

The invention relates to the pump engineering, and more specifically, it deals with hydraulic and pneumatic displacement pumps.

BACKGROUND OF THE INVENTION

Widely known in the art are piston pumps comprising a cylinder and a piston mounted for reciprocations in the cylinder. The cylinder communicates, via valves, with a source of fluid being pumped and with a delivery line. The piston is driven by a motor by means of a crank gear.

Discharge rate of such a pump may be increased by raising piston speed or increasing the pump size, but any increase in the discharge rate is limited by inertia forces and friction which becomes greater with an increase in the area of friction surfaces. An increase in the number of cylinders with pistons results in a decrease in power-to-weight ratio and efficiency and in an increase in metal weight-to-discharge ratio and also in a more complicated design. All these factors impose additional stringent requirements upon accuracy and finish in the manufacture.

Known in the art is a hydraulic actuator having a casing with an interior space in which a toroidal flexible shell is provided which is mounted for reciprocations and comprises a hose having the ends which are turned inside out and which are individually secured along the perimeter to the inner wall of the casing. An annular partition dividing the interior space into two chambers is provided in the casing between the fixed ends of the hose. The partition has a central opening with a sealing means, the hose passing from one chamber into the other through this opening. The chambers communicate with hydraulic lines for alternately supplying working fluid thereto (cf. SU, 918590).

When the hose passes through the central opening having the sealing means, folds are formed in the hose, and working fluid overflow from one chamber to the other occurs through these folds thus lowering efficiency. In addition, an increased friction occurs in the sealing means which also lowers efficiency and causes substantial wear of the hose and sealing members. The envelope moving almost completely from one chamber into the other requires the apparatus size to be very large.

SUMMARY OF THE INVENTION

The invention is based on the problem of providing a pump in which the interior of the casing is divided into two chambers in such a manner as to ensure their complete sealing with respect to each other thereby improving capacity and efficiency.

This problem is solved by that there is provided a pump comprising a casing having an interior space in which there is provided a flexible hose mounted for reciprocations having one end thereof which is turned inside out and secured along the perimeter to the inner wall of the casing and the other end thereof which is closed so as to sealingly divide the interior space of the casing into two chambers of which one chamber communicates with a source of fluid being pumped and with a delivery line, wherein, according to the invention, in order to move the flexible hose in one direction, its closed end is secured to a drum operatively connected to a motor and installed in one of the chambers, and movement in the opposite direction is effected under the action of working fluid pressure built-up in one of the chambers.

The drum is preferably installed in the chamber which commuicates with a working fluid admission and discharge system the other chamber communicates with a source of fluid being pumped and with the delivery line.

This arrangement makes it possible to pump one fluid using another fluid. Both fluids are completely separated so that any fluids an be used as working fluid and fluid being pumped.

The source of fluid being pumped may communicate with the other chamber at a point most remote from the point at which the end of the flexible hose is secured.

This communication of the source of fluid being pumped with the other chamber, when the drum is located in the chamber communicating with the system for admission and discharge of working fluid, the other chamber communicating with the source of fluid being pumped and delivery line, will make it possible, in vacuum applications, to create a gradual pressure reduction thus lowering cavitation, hence wear of the pump.

The source of fluid being pumped may communicate with the other chamber at a point adjacent to the point at which the end of the flexible hose is secured.

This communication, when the drum is located in the chamber communicating with the system for working fluid admission and discharge and when the other chamber communicates with the source of fluid being pumped and delivery line, makes it possible to create vacuum hammer.

A second source of fluid being pumped is preferably provided, a point of communication of the second source with the other chamber being located adjacent to the point where the end of the flexible hose is secured.

This arrangement, when the drum is located in the chamber communicating with the system for admission and discharge of working fluid and when the other chamber communicates with the source of fluid being pumped and delivery line and the first source of fluid being pumped communicates with the other chamber at a point most remote from the point at which the end of the flexible hose is secured, makes it possible to create simultaneously gradual and sudden pressure reduction.

It is also preferred that a second source of fluid being pumped be provided which communicates with the other chamber at a point adjacent to the point where the end of the flexible hose is secured, the points at which both said sources communicate with said chamber being equidistant from the point at which the end of the flexible hose is secured.

This construction, when the drum is located in the chamber communicating with the system for admission and discharge of working fluid and when the other chamber communicates with the source of fluid being pumped and delivery line and when the source of fluid being pumped communicates with the other chamber at a point adjacent to the point at which the end of the flexible hose is secured, makes it possible to carry out vacuum mixing of two fluids.

It is also preferred that a third source of fluid being pumped be provided, the point of communication of this source with the other chamber being located intermediate between points of communication of the first and second sources with said chamber.

This construction, when the drum is provided in the chamber which communicates with the system for admission and discharge of working fluid and when the other chamber communicates with the source of fluid being pumped and delivery line and the source of fluid being pumped communicates with the other chamber at a point most remote from the point at which the end of the flexible hose is secured and when there is provided a second source of fluid being pumped communicating with the other chamber at a point adjacent to the point at which the end of the flexible hose is secured, makes it possible to enlarge the processing capabilities so that three components of fluid being pumped can be mixed.

The drum may be provided in the chamber communicating with a source of fluid being pumped and delivery line, the other chamber being sealingly closed so as to create therein working fluid pressure reduction during movement of the flexible hose when its closed end is wound on the drum.

This arrangement makes it possible to pump fluid by rotating the drum, i.e. by means of a mechanical drive.

Two pumps according to the invention may be used for making-up an apparatus in which drum shafts are mounted coaxially with, and operatively connected to each other.

This construction makes it possible to improve discharge rate and lower pressure fluctuations of fluid being pumped in the delivery line.

Four pumps according to the invention may be used for making-up an apparatus in which the pumps have a common chamber in which at least one drum is provided, the longitudinal axes of the flexible hoses being equally spaced around the drum axis.

This construction makes it possible to pump four absolutely incompatible fluids using one and the same working fluid.

The pump according to the invention features higher discharge rate and efficiency with a comparatively simple design, while being more reliable in operation and having a longer service life. Requirements imposed upon accuracy and finish during manufacture are substantially lower, and metal weight-to-capacity ratio is substantially reduced.

The construction of the pump according to the invention substantially enlarges process capabilities of the employment of the pump since it is now possible to pump any fluids, create vacuum with deep pressure reduction, both gradually and suddenly, and also to carry out vacuum mixing of different fluids.

BRIEF DESCRIPTION OF THE DRAWINGS

Specific embodiments of the pump according to the invention will now be described in detail with reference to the accompanying drawings, in which.

BEST MODE FOR CARRYING OUT THE INVENTION

Figure 1:
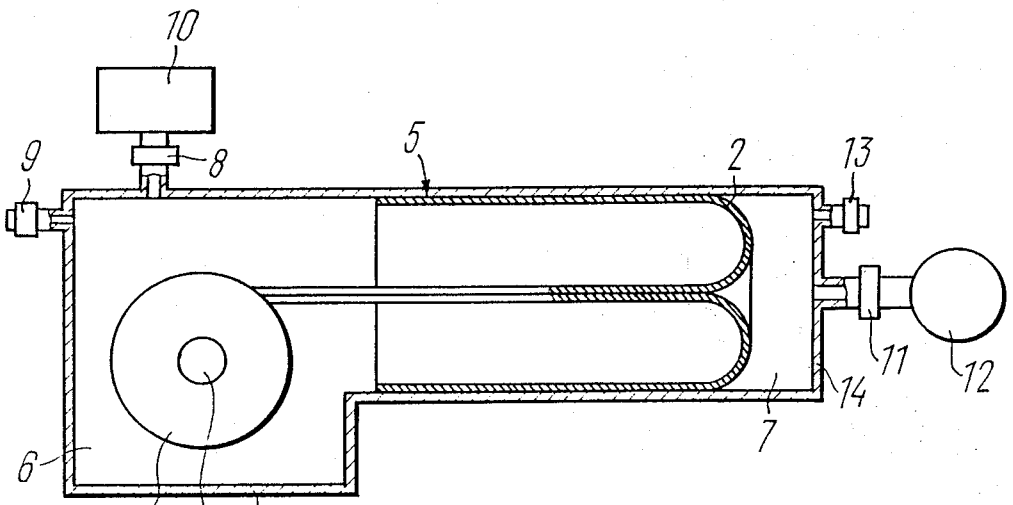
FIG. 1 schematically shows a pump according to the invention, a longitudinal sectional view.

A pump according to the invention comprises a casing 1 (FIG. 1) having an interior space accommodating a flexible hose 2 and a drum 3 having a shaft 4 operatively connected to a motor (not shown). One end 5 of the flexible hose 2 is turned inside out and secured along the perimeter to the inner wall of the casing 1. The other end of the flexible hose 2 is closed and connected to the drum 3 so as to sealingly divide the interior space of the casing 1 into two chambers 6 and 7, respectively. Therefore, the drum 3 is located in the chamber 6 which communicates, via an admission valve 8 and a discharge valve 9, with a source of working fluid 10 and with the environment, respectively. The chamber 7 communicates, via a valve 11, with a source 12 of fluid being pumped and, via a valve 13, with a delivery line.

In this embodiment, the point at which the chamber 7 communicates with the source 12 of fluid being pumped is at the end wall 14 of the casing 1, i.e. it is most remote from the point at which the end 5 of the flexible hose 2 is secured. This location of the point at which the source 12 of fluid being pumped communicates with the chamber makes it possible to create a gradual pressure reduction in vacuum applications.

To carry out sudden pressure reduction, a point 15 (FIG. 2) at which the source of fluid being pumped communicates with the chamber is located adjacent to the point at which the end 5 of the flexible hose 2 is secured.

Figure 3:
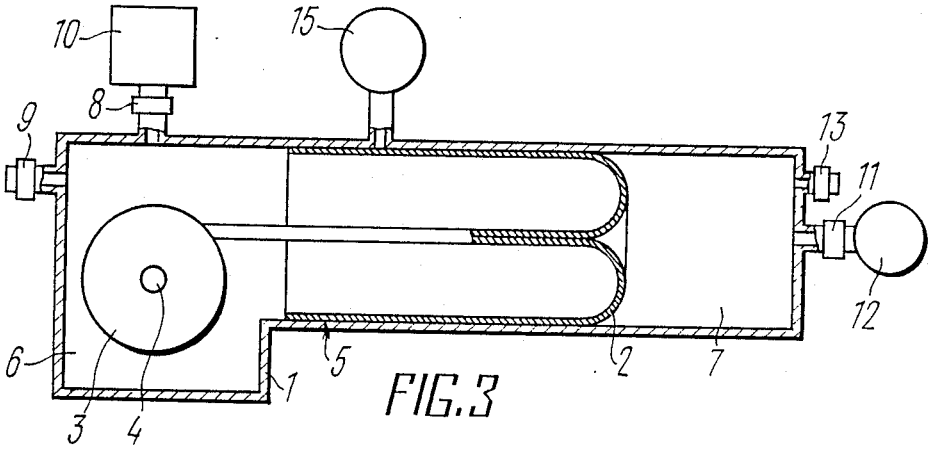
FIG. 3 is a schematic longitudinal section view of a pump with two sources of fluid being pumped.

In the embodiment of the pump shown in FIG. 3 there are two sources of fluid being pumped: the source 12 communicating with the chamber 7 at a point most remote from the point at which the end 5 of the flexible hose is secured, and a source 15 which communicates with the chamber 7 at a point adjacent to the point at which the end 5 of the flexible hose is secured. This arrangement makes it possible to create pressure reduction gradually in one source and suddenly in the the source.

Figure 4:
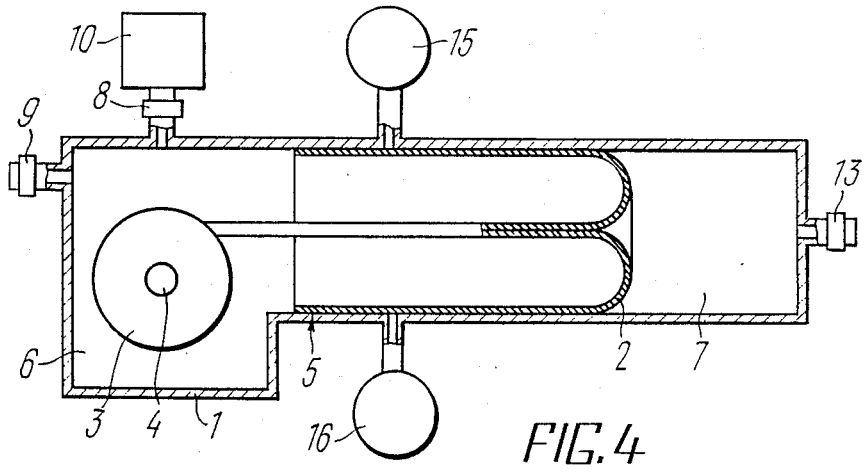
FIG. 4 is a schematic longitudinal section view of a pump, with two sources of fluid being pumped communicating with the other chamber at points equidistant from the point at which the end of a flexible hose is secured.

To improve mixing of two fluids during pumping, in the embodiment of the pump shown in FIG. 4, a point at which a second source 16 of fluid being pumped communicates with the chamber 7 and a point at which the source 15 of fluid being pumped communicates with the chamber 7 are equidistant from the point at which the end 5 of the flexible hose 2 is secured.

Figure 5:
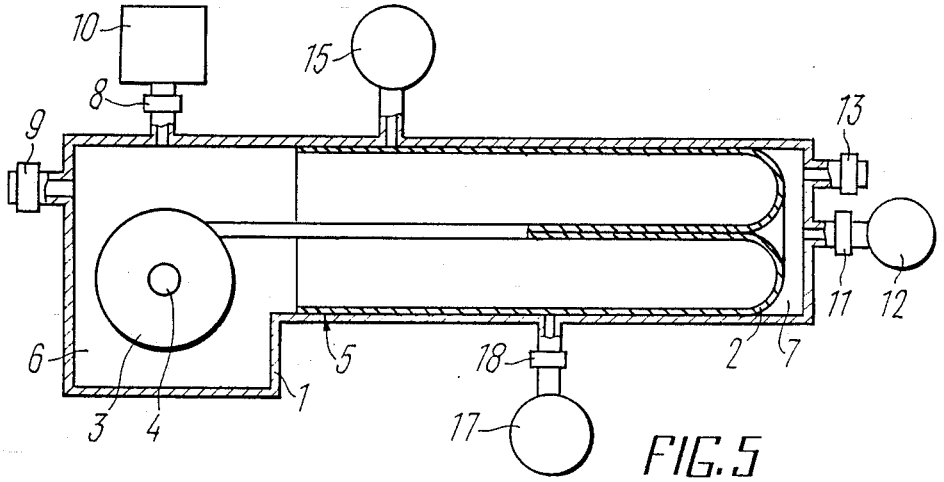
FIG. 5 shows a pump with three sources of fluid being pumped.

For mixing three fluids, a third source 17 (FIG. 5) of fluid being pumped is provided, a point at which this third source communicates with the chamber 7 via a valve 18 being located intermediate between the points at which the first source 12 and the second source 15 communicate with the chamber 7.

Figure 6:
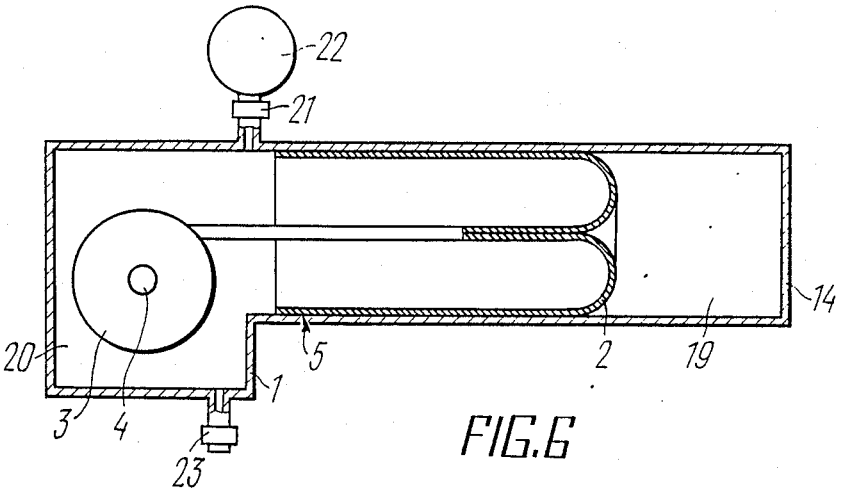
FIG. 6 shows a pump according to the invention, with a sealingly closed other chamber.

To simplify the design by dispensing with a working fluid source in the pump shown in FIG. 6, a chamber 19 is sealingly closed, and a chamber 20 in which a drum 3 is provided, communicates via a valve 21 with a source of a fluid being pumped and via a valve 23, with the delivery line.

Figure 7:
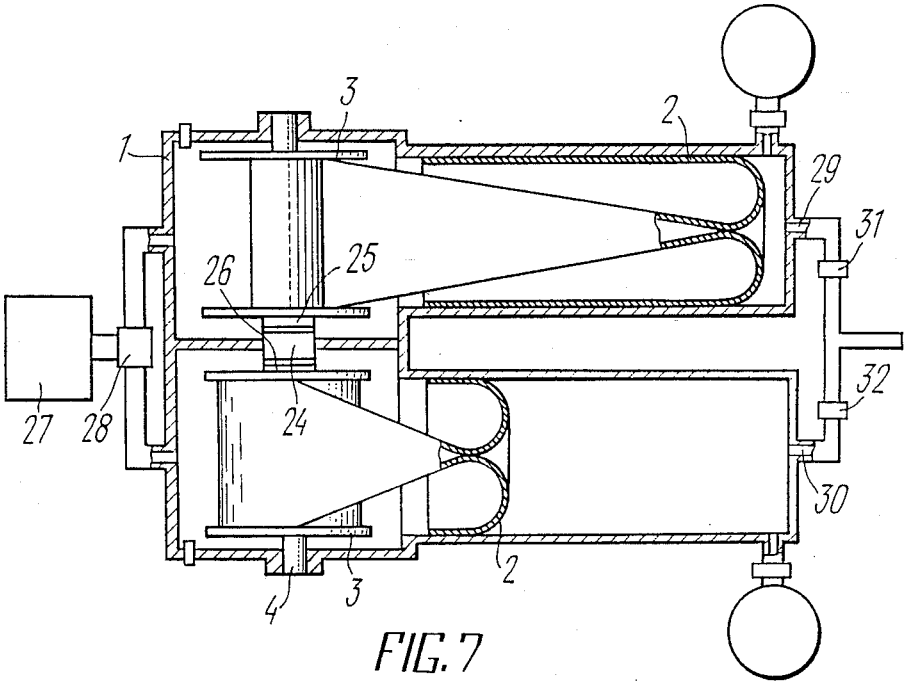
FIG. 7 shows an apparatus having two pumps according to the invention.

FIG. 7 shows an apparatus having two pumps according to the invention, each being substantially similar to one of the embodiments shown in FIGS. 1 through 5. The shafts 4 with the drums 3 are installed coaxially with, and operatively connected to each other by means of a clutch member 24 mounted on the shaft 4 which is alternately engageable with clutch members 25 and 26 of the drums 3. Both pumps are supplied from one and the same source 27 of working fluid, the alternate communication with the source of working fluid being effected by means of a control valve 28. Delivery lines 29 and 30 of the pumps are interconnected by means of check valves 31 and 32, respectively. This arrangement makes it possible to increase discharge rate and lower fluctuations of pressure of fluid being pumped.

Figure 8:
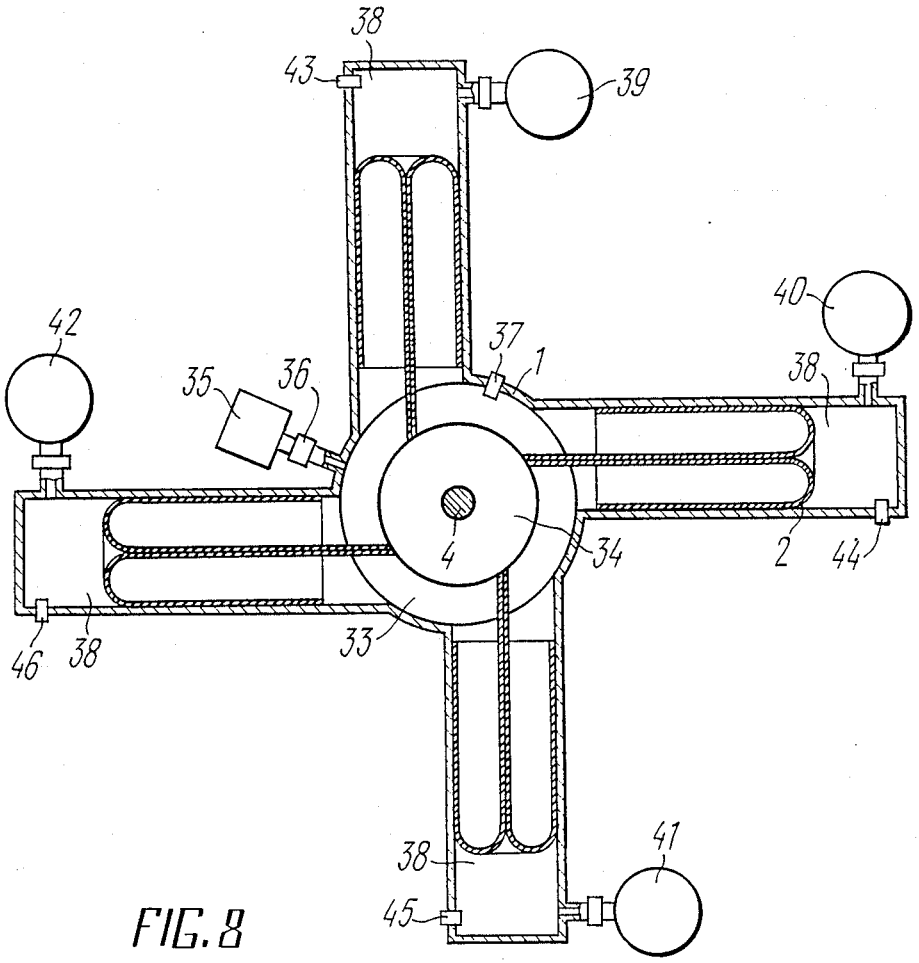
FIG. 8 shows an apparatus having four pumps according to the invention.

In the embodiment of the apparatus shown in FIG. 8 and having four pumps according to the invention, the pumps have a common chamber 33 in which a drum 34 is installed and which has closed ends of flexible hoses 2 secured thereto. Longitudinal axes of the flexible hoses 2 are equally spaced around the axis of the drum 3. The chamber 33 communicates with a source 35 of working fluid and with the environment through valves 36 and 37, respectively. Each of the pumps has an individual chamber 38 communicating with sources 39, 40, 41, 42 of fluid being pumped and with delivery lines 43, 44, 45, 46, respectively.

The pump functions in the following manner.

Working fluid is admitted from the source 10, via the open valve 8, to the chamber 6. The hose 2 is payed-off from the drum 3 freely rotating on the shaft 3 and reaches the end wall 14. The pump is now ready for operation. The valve 9 for communication of the chamber 6 with the environment and the valve 11 for communication of the chamber 7 with the source 12 of fluid being pumped are opened. The closed end of the hose 2 is wound on the drum 3 when the latter is rotated by a drive means, and the hose 2 will displace working fluid from the chamber 6. Pressure reduction occurs in the chamber 7, and fluid being pumped is sucked into the chamber from the source 12. When the hose 2 reaches the opposite end position adjacent to the point at which the end 5 is secured, the chamber 7 is filled-up with fluid being pumped. The valves 9 and 11 are closed and the valves 8 and 13 are opened. Working fluid under pressure is admitted from the source 10 to the chamber 6 to move the hose 2 towards the end wall 14. The hose 2 is payed-off from the freely rotating drum and displaces fluid being pumped from the chamber 7 through the valve 13 into the delivery line. Then the above-described cycle is repeated.

Figure 2:
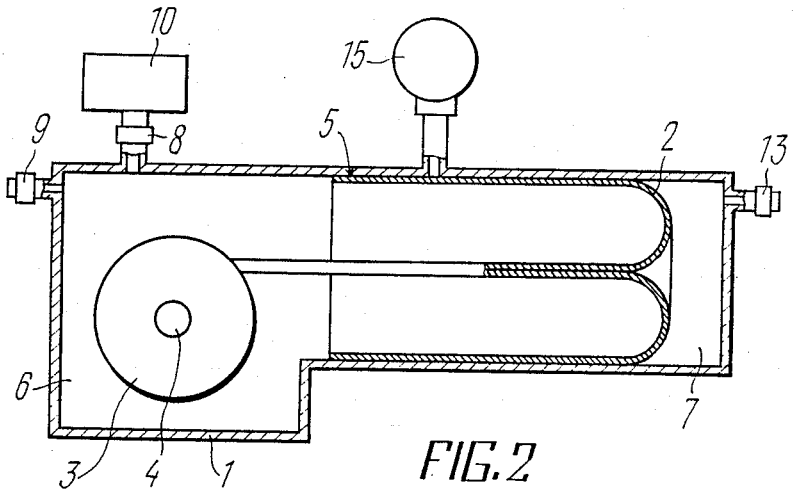
FIG. 2 is a schematic longitudinal section view of a pump with a source of fluid being pumped communicating with the other chamber adjacent to the point at which the end of a flexible hose is secured.

In the embodiments of the pump shown in FIGS. 2,3,4 operation occurs substantially similarly to the above given description. Since in the embodiment shown in Figure 2 the point at which the source 15 of fluid being pumped communicates with the chamber 7 is located adjacent to the point at which the end 5 of the hose 2 is secured, the latter will seal-off the point at which the chamber 7 communicates with the source 15 during unwinding from the drum 3. When the hose 2 is wound on the drum 3, the chamber 7 will be sealingly closed, and pressure reduction will occur therein until the moment at which the hose 2 will open communication with the source 15 in which vacuum will be suddenly produced.

In the embodiment of the pump having two sources 12 and 15 of fluid being pumped (FIG. 3), when the hose 2 is wound on the drum 3, a gradual pressure reduction is effected in the source 12, and a sudden pressure reduction will occur in the source 15.

For improving mixing of two fluids (FIG. 4), the embodiment is used wherein the sources 15 and 16 of components of fluid being pumped are equally spaced from the point at which the end 5 of the hose 2 is secured. When the hose 2 is wound on the drum 3, vacuum is created in the chamber 7. When the hose 2 simultaneously uncovers both points at which the sources 15 and 16 communicate with the chamber, jets of components of fluid being pumped will escape at high velocity from both sources, to collide and to be comminuted and mixed in the resultant vortices. When the hose 2 is unwound by pumping working fluid into the chamber 6, the resultant mix will be displaced into the delivery line.

For mixing three components of fluid being pumped (FIG. 5), a pump with the three sources 11, 15 and 17 of fluid being pumped is used. When the hose 2 is wound on the drum 3, the valves 11 and 18 of the sources 12 and 17, respectively, are opened. Pressure reduction occurs in the chamber 7 so that fluids being pumped are admitted from the source 12 and from the sources 17 and 15 as they are uncovered by the hose 2. When the chamber 7 is filled with fluid being pumped, which includes three components, the valves 9, 11 and 18 are closed, and the valves 8 and 13 are opened. Operation then occurs similarly to the abovedescribed embodiments, the point at which the source 15 communicates with the chamber being covered by the hose when mixture displacement into the delivery line begins.

When vacuum is used in the pump (FIG. 6) to replace working fluid, the initial position of the flexible hose 2 is that in which it is unwound and adjacent to the end wall 14. The valve 21 of the source 22 of fluid being pumped is open, the valve 23 of the delivery line is closed. Fluid being pumped flows under gravity into the chamber 20 to fill it. The pump is ready for operation. The valve 21 is closed, and the valve 23 is opened. When the hose 2 is wound on the drum 3, the fluid being pumped is displaced through the valve 23 into the delivery line. At the same time, pressure reduction occurs in the chamber 19. Then the valve 23 is closed, and the valve 21 is opened. Pressure in the chamber 20 becomes greater than that in the chamber 19. The drum 3 is disengaged from the drive means. Owing to a pressure difference between both chambers, the hose 2 starts being freely unwound from the drum 3 in the direction towards the end wall 14. The volume of the chamber 20 increases, and fluid being pumped is sucked therein. Then the cycle is repeated.

The apparatus shown in FIG. 7 comprises two pumps having their drums 3 mounted on coaxial shafts 4. Operation of each of the pumps is similar to operation of the pumps described above. While one pump performs suction of fluid being pumped, the other pump performs delivery. The valve 28 alternately establishes communication of the source 27 of working fluid with respective chamber of each pump. The clutch members 25 and 26 of the drums 3 alternately come in engagement with the clutch member 24 coupled to the drive means. The valves 31 and 32 alternately establish communication of respective chambers with the delivery line.

Not only does the use of the two-pump apparatus result in an increased discharge rate, but it also lowers fluctuations of pressure of fluid being pumped.

Four pumps making-up the apparatus shown in FIG. 8 function similarly to the pumps described above. Rotation of the drum 34 ensures winding of four hoses 2 simultaneously for concurrent suction of four fluids being pumped into the chamber 38 of each of the pumps from the sources 39, 40, 41 and 42, respectively. Supplying working fluid from the source 35 of working fluid ensures unwinding of all hoses and displacement of fluids being pumped from each respective pump.

This apparatus makes it possible not only to improve discharge rate, but also to pump absolutely different fluids.

The pump according to the invention is capable of pumping large amounts of fluid. The discharge rate of a pump with a hose 10 m in diameter and 50 m long is 25 $m^3/s$.

The pump according to the invention may be used for creating vacuum. The vacuum of $10^{-2}$ is created during 300 s in a volume of 3000 $m^3$.

INDUSTRIAL APPLICABILITY

The pump according to the invention may be most advantageously used for pumping liquids.

The invention may also be used for creating vacuum and also for mixing various fluids by vacuum technique.

We claim:

1. A pump comprising a casing (1) having an inner wall and an interior space having a flexible hose (2) mounted for reciprocation having a first end (5) which is turned inside out and sealingly secured along the perimeter to the inner wall of the casing (1) and a second end which is closed so as to sealingly divide the interior space of the casing (1) into two chambers (6, 7) wherein one chamber communicates with a source (12) of fluid being pumped and with a delivery line, the second end is secured to a drum operatively connected to a motor arranged in one of the chambers (6, 7), to move the flexible hose in one direction, and means for effecting movement in the opposite direction by the action of a pressure of a working fluid in one of the chambers (6, 7).

2. A pump according to claim 1, characterized in that the drum (3) is provided in the chamber (6) communicating with a system for admission (8, 10) and discharge (9) of working fluid, the other chamber (7) communicating with the source (12) of fluid being pumped and with the delivery line.

3. A pump according to claim 2, characterized in that the source (12) of fluid being pumped communicates with the other chamber (7) at a point remote from the point at which the end (5) of the flexible hose (2) is secured.

4. A pump according to claim 3, characterized in that there is provided a second source (15) of fluid being pumped and a point at which this second source (15) communicates with the other chamber (7) is located adjacent to the point at which the end (5) of the flexible hose (2) is secured.

5. A pump according to claim 1, characterized in that the drum (3) is provided in the chamber (20) communicating with the source (22) of fluid being pumped and delivery line, the other chamber (19) being sealingly closed for creating pressure reduction of working fluid therein during movement of the closed end of the flexible hose (2).

6. A pump according to claim 1, comprising a plurality of pumps wherein the shafts (4) of the drums (3) are mounted coaxially with, and operatively connected to each other.

7. A pump according to claim 1, comprising four pumps wherein the pumps have common chamber (33) wherein there is provided at least one drum (34), the longitudinal axes of the flexible hoses (2) being equally spaced around the axis of the drum (34).

8. A pump of claim 2 having sources of pumped fluid arranged along the casing between the first end of the hose and an end of the casing in communication with the delivery line.

9. A pump according to claim 8, characterized in that the source (15) of fluid being pumped communicates with the other chamber (7) at a point adjacent to the point at which the end (5) of the flexible hose (2) is secured.

10. A pump according to claim 8, characterized in that there is provided a second source (16) of fluid being pumped communicating with the other chamber (7) at a point adjacent to the point at which the end (5) of the flexible hose (2) is secured, the points at which both said sources (15, 16) communicate with said chamber (7) being equidistant from the point at which the end (5) of the flexible hose (2) is secured.

11. A pump according to claim 8, characterized in that there is provided a third source (17) of fluid being pumped, communicating with the other chamber (7) at a point which is located intermediate between the points at which the first (11) and second (15) sources communicate with said chamber (7).

* * * * *